US005300200A

United States Patent [19]

Horányi

[11] Patent Number: 5,300,200

[45] Date of Patent: Apr. 5, 1994

[54] METHOD FOR STABILIZING THE EFFECTIVE DISSOLUTION VALENCE OF SILICON DURING ELECTROCHEMICAL DEPTH PROFILING

[75] Inventor: Tamás S. Horányi, Budapest, Hungary

[73] Assignee: Semiconductor Physics Laboratory RT, Budapest, Hungary

[21] Appl. No.: 964,356

[22] Filed: Oct. 21, 1992

[51] Int. Cl.[5] ..... C25F 3/12; C25F 3/30

[52] U.S. Cl. ..... 204/129.2; 204/129.3; 204/129.75; 204/129.7

[58] Field of Search ..... 204/129.3, 129.2, 129.75, 204/129.7

[56] References Cited

U.S. PATENT DOCUMENTS

| | | | |
|---|---|---|---|
| 4,028,207 | 6/1977 | Faktor et al. | 204/129.3 X |
| 4,168,212 | 9/1979 | Faktor et al. | 204/129.3 X |
| 4,995,939 | 2/1991 | Ferenczi et al. | 204/129.3 X |
| 5,139,624 | 8/1992 | Searson et al. | 204/129.3 |

OTHER PUBLICATIONS

Horányi, et al., "Electrochem'l Method for Measurement of Doping Profiles in Si", Proc. of 3rd European Conf. on Crystal Growth, Budapest Hungary, May 5-11 (1991).

Sharpe, et al., "Electrolyte-Si Interface, Anodic Dissolution and Carrier Concentration Profiling", J. Electrochem. Soc. 127, 1918 (1980).

Sharpe, et al., "Electrochemical Carrier Concentration Profiling in Si", Electronics Letters 15, 622 (1979).

Kechang, et al., "Determination of the Depth Distribution of Carriers in Si", etc., Thin Solid Films 184, 47-54 (1990).

Sieber, et al., "Application of Electrochem'l Capacitance-Voltage Measurements for Profiling in Si", Phys. Stat. Sol. (a) 126, K123 (1991).

Pham, et al., "Bestimmung von Ionenimplantationsprofilen, u.s.w.", Phys. Stat. Sol. (a) 37, 439 (1976) [no English translation available].

*Primary Examiner*—Donald R. Valentine

[57] ABSTRACT

The accuracy of electrochemical profiling measurements that provide depth dependent characteristics for a semiconductor is enhanced by stabilizing the semiconductor's effective dissolution valence. According to the present invention, the semiconductor dissolution valence is stabilized by anodically dissolving the semiconductor surface using a potential associated with the electropolishing region of the semiconductor. This potential, typically 1V to 5V relative to the profiler saturated calomel reference electrode, favors quadrivalent dissolution over divalent dissolution. Dissolution valence is further stabilized by using an electrolyte having a relatively low fluoride content, a characteristic associated with a low dissolution rate (relative to a rate of electrochemical oxidation) of the oxide at the semiconductor surface. Preferably the electrolyte has a fluoride content in the approximate range 0.01 $mol-dm^{-3}$ to about 1.0 $mol-dm^{-3}$, and is buffered with a pH ranging from about 3 to 5. According to the present invention, the effective dissolution valence of silicon is stabilized to about 3.70, and craters etched in a silicon specimen will have a deviation from a mean profile depth within about $\pm 1\%$.

24 Claims, 12 Drawing Sheets

METHOD FOR STABILIZING THE EFFECTIVE DISSOLUTION VALENCE OF SILICON DURING ELECTROCHEMICAL DEPTH PROFILING

FIELD OF THE INVENTION

The invention relates generally to measuring carrier concentration in semiconductor materials using electrochemical profiling techniques, and more specifically to a method for stabilizing the effective dissolution valence of silicon to provide more accurate measurements using such techniques.

BACKGROUND OF THE INVENTION

Semiconductor materials contain majority and minority carriers that govern the performance of transistors and other semiconductor devices fabricated from such materials. In the design and fabrication of such devices, it is important to know the concentration of these carriers at various depths within the semiconductor material.

It is known in the art to measure carrier concentration in semiconductor materials using electrochemical profiling techniques, also known as anodic dissolution techniques. According to these techniques, concentration measurements are made at various levels in a semiconductor material as the semiconductor material is controllably dissolved, layer-by-layer.

For example, U.S. Pat. No. 4,028,207 issued in 1977 to M. M. Faktor, et al. discloses a measuring apparatus wherein an electrolyte forms a Schottky barrier with the semiconductor surface while controllably dissolving the semiconductor surface to expose new regions. When high anodic potential is applied, the electrolyte etches more deeply into the semiconductor, and data relating carrier concentration to the new depth may be obtained. The Semilab MCS-90, manufactured by Semiconductor Physics Laboratory RT of Budapest, Hungary, is an example of a modern electrochemical profiler.

FIG. 1 depicts a typical apparatus 2 for making electrochemical profile measurements according to the prior art, an apparatus with which the present method may be practiced to provide improved measurement data. The semiconductor specimen 4 is supported on an electrolytic cell 6 that typically includes a saturated calomel reference electrode ("SCE" ) 8, a graphite cathode auxiliary electrode 10, and a light source 12 (used to create holes when specimen 4 is n-type material).

A suitable mechanism 14 exerts force against specimen 4 to maintain intimate contact between the specimen surface 16 that is to be etched, and an area (A) of electrolyte 18. The interface at surface 16 between the specimen 4 and the electrolyte 18 forms a rectifying or so-called Schottky barrier. Collectively, the semiconductor-electrolyte system including interface surface 16 forms what is commonly referred to as the semiconductor working electrode. Preferably a gold electrode 20 contacts surface 16, while contact mechanism 40 urges ohmic contact between platinum pins 22 and 24 and the non-etched side 26 of the specimen 4. A pump 28 is optionally used in the prior art, generally to circulate the electrolyte 18.

A bias voltage source 30 provides a swept anodic potential $V_a(t)$ that is coupled to the first input of a potentiostat 32, whose second input is coupled to the SCE electrode 8. Potentiostat 32 provides an anodic output etching current i(t) that is coupled to the graphite electrode 10. Potentiostat 32 essentially imposes the reference, or anodic, potential $V_a(t)$ upon the SCE electrode 8. As used herein, the anodic potential $V_a(t)$ is understood to be referenced to the SCE electrode 8.

The platinum pins 22, 24 couple a signal generator 34 to specimen 4 to facilitate data measurements using the gold electrode 20 and alternating current ("AC") circuitry 38. As the anodic voltage from source 30 is swept (e.g., varied), the semiconductor depletion region at the semiconductor interface 16 changes, thus varying the interface admittance. The admittance at the specimen-electrolyte interface 16 has real and imaginary components, whose respective magnitudes may be determined by AC circuitry 38.

AC circuitry 38 typically includes phase-sensitive components that permit characterization of specimen 4 at various depths, using, for example, the real and imaginary interface admittance components to determine the interface capacitance $C_{Si-E}$. Direct current ("DC") circuitry 36 typically includes components for integrating the anodic current i(t) to enable a determination of the semiconductor etch depth $W_R$. Circuitry 36 and 38 can provide output data that may, for example, be used to represent semiconductor parameters as a function of etch depth, in an X-Y plot, for example.

In practice, for an n-type semiconductor specimen, anodic dissolution of surface 16 typically occurs at a fixed anodic potential $V_a$ that is maintained by the potentiostat 32, at a rate determined by the number of minority carriers (holes) produced by photons from light source 12. For p-type material, sufficient anodic current i(t) exists without illumination from light source 12, due to the relatively large number of available minority carriers (electrons).

As understood by those skilled in the relevant art, data representing semiconductor depth ($W_R$) are provided by taking the integral of the dissolution current i(t), $$W_R = \frac{M}{N \cdot F \cdot D \cdot A} \cdot \int i(t)dt$$

where M is the semiconductor's molecular weight, N is the effective dissolution valence of the semiconductor specimen, F is the Faraday constant, D is the semiconductor density, and A is the dissolution area.

To produce a carrier concentration profile, $W_R$ must be added to the depletion width $W_D$, $$W_D = \epsilon \cdot \epsilon_o \cdot \frac{A}{C_{Si-E}}$$

where, as noted, A is the dissolution or etch area, and $C_{Si-E}$ is the overall interface capacitance.

From the foregoing, it will be appreciated that if the effective dissolution valence N cannot be reliably and consistently maintained and determined, meaningful measurements of $W_R$ cannot be attained. Similarly, one cannot obtain accurate and reliable measurements of other semiconductor parameters that depend upon N or $W_R$.

While electrochemical profile measurements as described above have been used for many years, in practice the data obtained can be inconsistent and vary widely. In addition to the measurements being dependent upon the electrolyte selected and the electrolyte pH, the depth calculations are very sensitive to the effective dissolution valence of the semiconductor (the number of electronic charges transferred per atom of semiconductor dissolved). In fact, the inability to reliably maintain a consistent effective dissolution valence has caused electrochemical depth profiling to fall out of favor for silicon specimens, especially for multilayer silicon specimens.

What is needed in electrochemical depth profiling is a method for reliably maintaining a consistent effective dissolution valence for a semiconductor specimen, thereby promoting more accurate depth measurement data. The present invention provides such a method.

SUMMARY OF THE INVENTION

The present invention is used during electrochemical profiling to stabilize a semiconductor specimen's effective dissolution valence by causing electrochemical etching to occur at anodic potentials that promote quadrivalent dissolution rather over divalent dissolution. These anodic potentials correspond to the electropolishing region of the semiconductor under examination, and preferably range from about 1V to 5V,, relative to the saturated calomel reference ("SCE") electrode.

Further, the effective dissolution valence is made relatively independent of semiconductor and electrochemical profile process parameters by using an electrolyte with a relatively low fluoride content. Such an electrolyte is associated with a relatively low dissolution rate of the oxide formed at the specimen's surface during electrochemical etching. Preferably the electrolyte is buffered, and has a fluoride content in the range of about 0.01 $mol-dm^{-3}$ to 1.0 $mol-dm^{-3}$, with pH ranging from about 3 to 5.

The present invention permits the effective dissolution valence of silicon to be stabilized at about 3.70{3%. Profiles etched according to the present invention maintain a deviation from a mean profile depth of ±1% or less.

Other features and advantages of the invention will appear from the following description in which the preferred embodiments have been set forth in detail in conjunction with the accompanying drawings.

DETAILED DESCRIPTION OF THE PREFERRED EMBODIMENTS

As noted, electrochemical profiler depth measurements are subject to error for a number of reasons, including an inability to effectively stabilize the effective dissolution valence of the semiconductor specimen.

Figure 1:
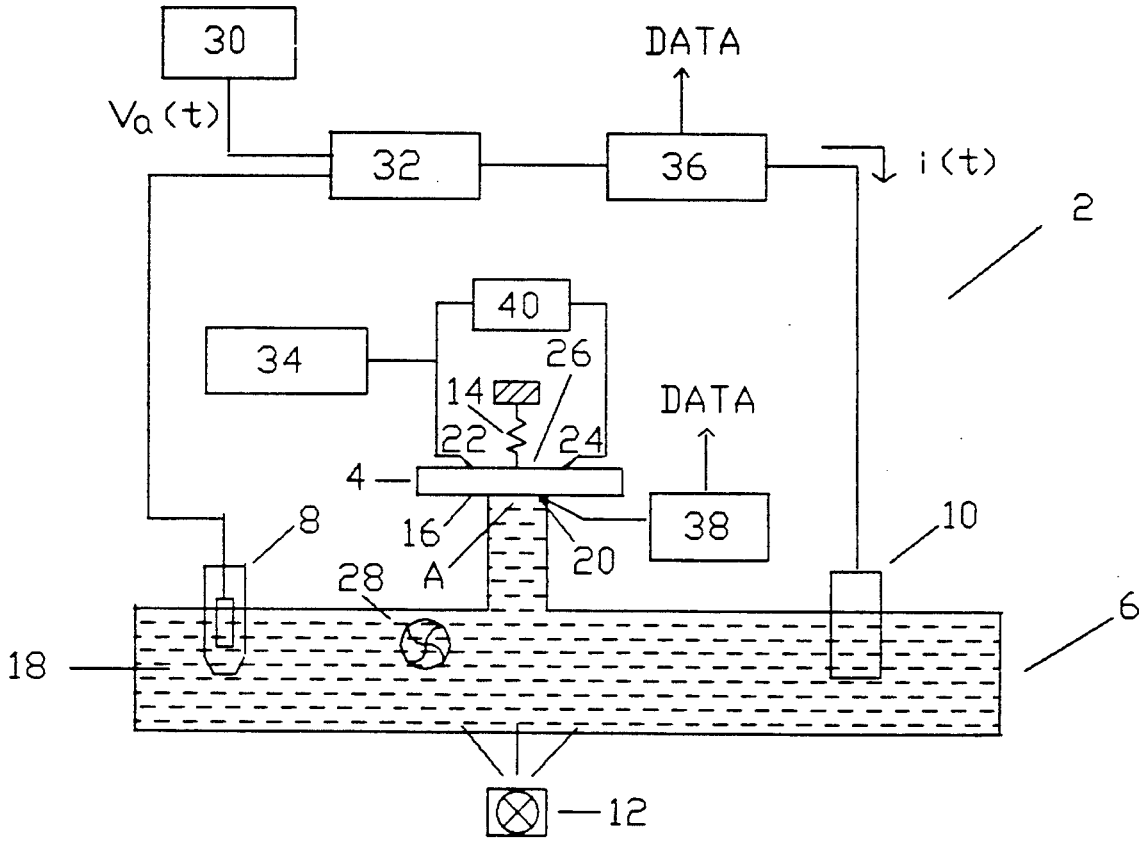
FIGURE 1 (PRIOR ART)
FIG. 1 depicts a conventional electrochemical profiler apparatus for measuring minority carrier concentrations in a semiconductor specimen, an apparatus with which the present invention may be practiced.

Applicants have discovered that during depth profiling (using for example an apparatus similar to FIG. 1), the specimen's effective dissolution valence can be stabilized by suitably selecting the anodic voltage, the electrolyte and electrolyte pH, and by continuous agitation of the electrolyte at the specimen surface. According to the present invention, the effective dissolution valence is stabilized by promoting dominant quadrivalent dissolution through the selection of the anodic potential. The effective dissolution valence is further stabilized by the relatively low specimen surface oxide dissolution rate (compared to the electrochemical oxidation rate), a condition promoted by the use of a low fluoride content electrolyte.

Figure 2A:
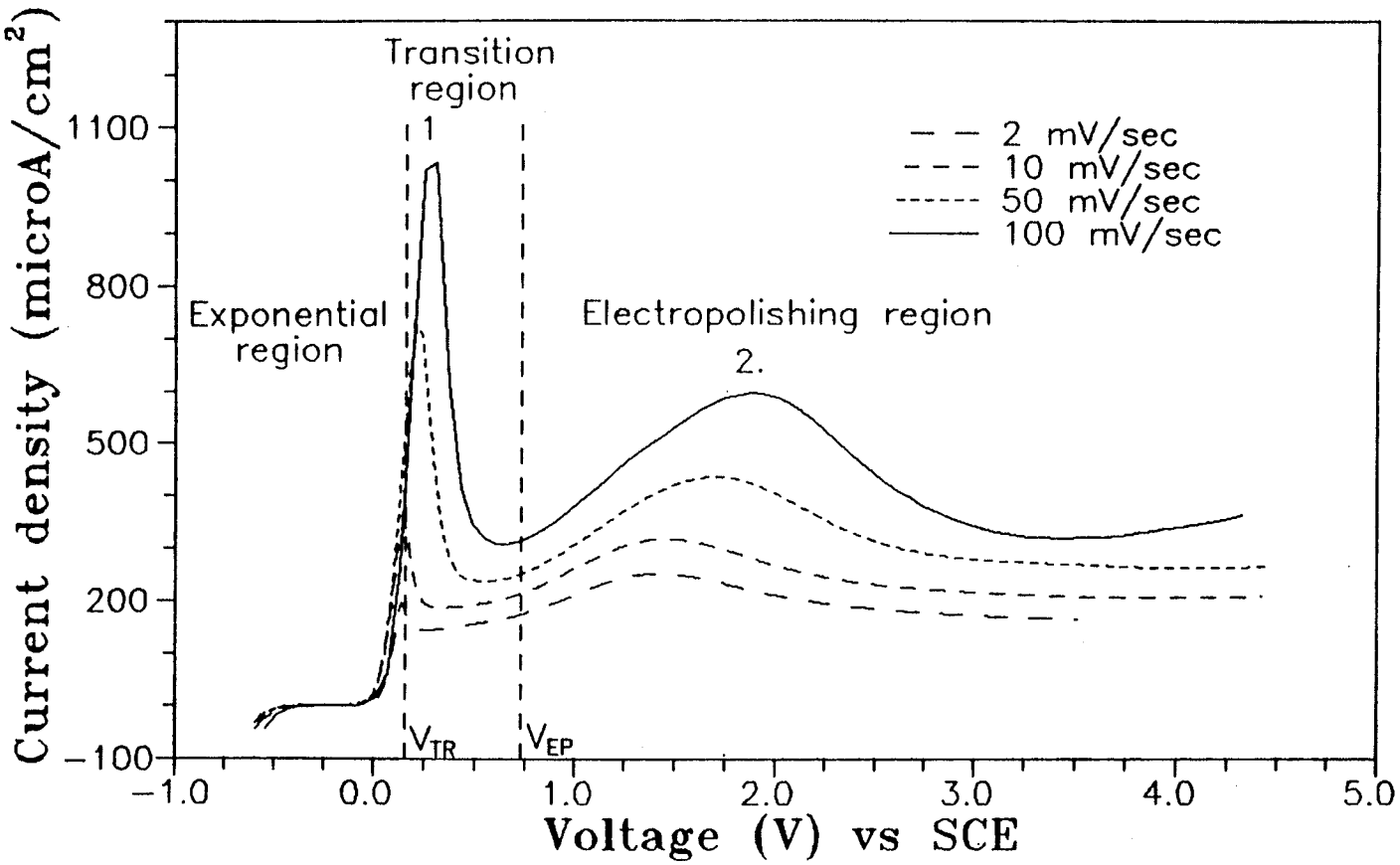
FIG. 2A depicts transition and electropolishing regions for a silicon specimen under anodic dissolution.

FIG. 2A is a voltammogram representing data taken on a Semilab MCS-90 electrochemical profiler, at ambient temperature and optimized measuring and modulation frequencies. Data were obtained for a p-type silicon specimen having an area (A) of 10 $mm^2$.

With reference to FIG. 2A, at relatively low anodic potentials $V_a$, measured relative to the reference saturated calomel electrode ("SCE") 8, the current density at the semiconductor specimen surface 16 increases exponentially In this low anodic potential region, e.g., $V_a < V_{TR}$, it is believed that porous silicon is formed during dissolution. This reaction appears to be charge-transfer controlled in that the current density buildup is an exponential function of the anodic potential.

For further increases in anodic potential beyond $V_{TR}$, the current density peak (peak 1) at the transition region appears to signal an apparent change in the silicon dissolution mechanism. In the transition region corresponding to $V_a \geqq V_{tr}$, it is believed that the semiconductor surface 16 is no longer completely covered by the porous silicon layer.

Thereafter, as the anodic potential is increased beyond $V_{TR}$, the current density decreases and then begins to increase as an electropolishing region is entered at $V_a \approx V_{EP}$. This region is commonly referred to as the electropolishing region because dissolution of the silicon surface dissolves an oxide film that is readily formed at the semiconductor-electrolyte interface 16. As the anodic potential $V_a$ is increased beyond the second peak (peak 2), the current density gradually decreases in a relatively smooth fashion, as shown.

Applicants' analysis of FIG. 2A led to the conclusion that smooth and homogeneous etching of a silicon specimen could best be carried out at anodic potentials $V_a$ corresponding to the specimen's electropolishing region. The presence of the second broad current peak (peak 2) suggested that the dissolution process and/or the properties of the oxide film at the specimen-electrolyte interface were not uniform over the entire electropolishing region.

As indicated by the legend in the upper corner of FIG. 2A, current density was measured at various rates of change for potential 32. Current density data in the exponential region of FIG. 2A appears to be relatively independent of the voltage sweep rate of change, an expected result for a charge transfer controlled reaction.

Figure 2B:
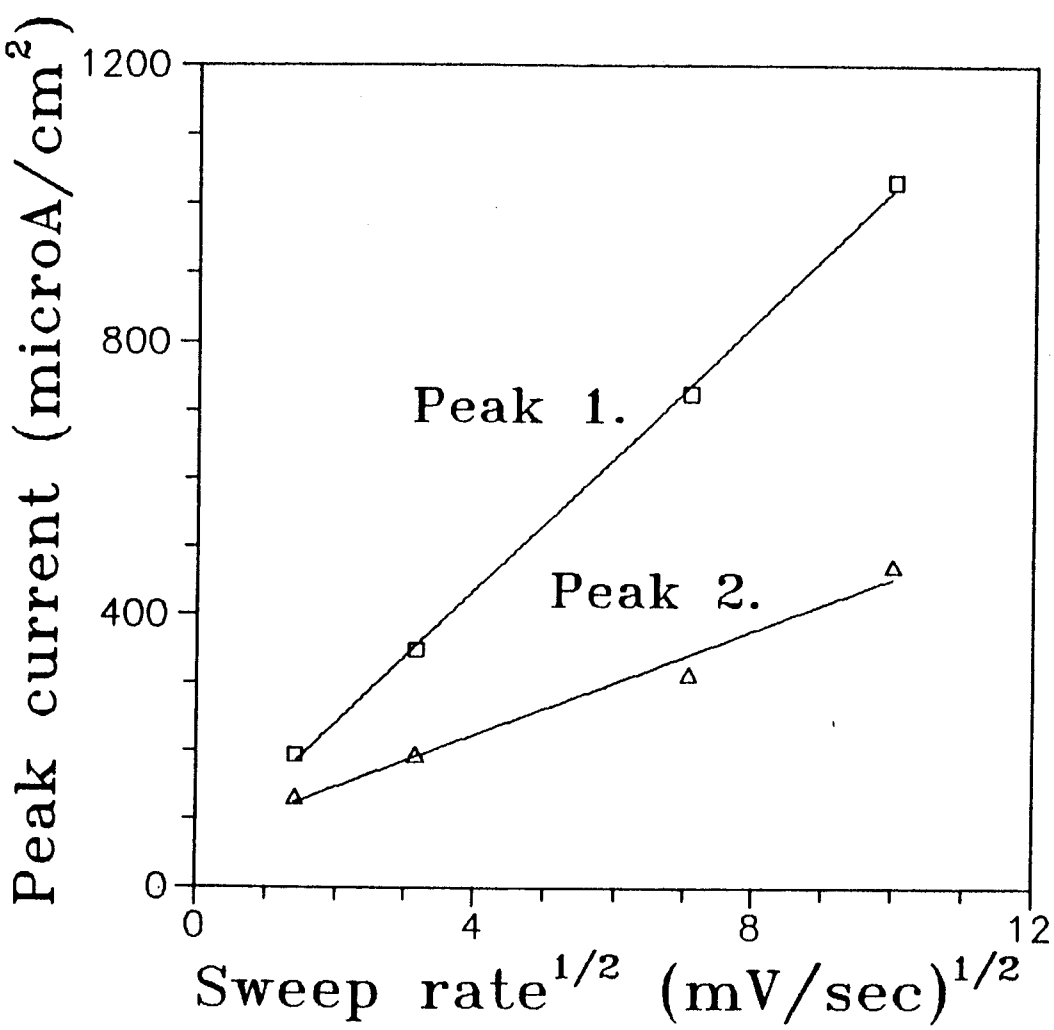
FIG. 2B depicts the relationship between peak current densities and anodic voltage sweep rates for the data depicted in FIG. 2A.

However as shown by FIG. 2B, the peak current densities for peak 1 and peak 2 vary linearly as the square root of the voltage sweep rate. Relationships such as depicted in FIG. 2B may be associated with diffusion controlled electron transfer processes, according to linear sweep voltammetry theory.

It was also known that beyond the exponential region, silicon dissolution is primarily diffusion limited in electrolyte having a low fluoride content (e.g., less than about 1 $mol-dm^{-3}$). The foregoing observations led applicants to attribute peak 1 in FIG. 2A to dominant divalent dissolution of silicon, and peak 2 to a dominant quadrivalent dissolution of silicon.

Both dissolution modes appear to occur simultaneously in that hydrogen gas bubbles, which are associated with simultaneous dissolution modes, are formed at the etched surface during dissolution. Anodic potentials of 3.5V or higher appear to reduce hydrogen generation. According to the present invention, a mechanism 28 (indicated in phantom in FIG. 1), such as a peristaltic pump, is used to remove gaseous products from the silicon-electrolyte interface 16, and to agitate the electrolyte 18 to promote diffusion at the interface.

Figure 3:
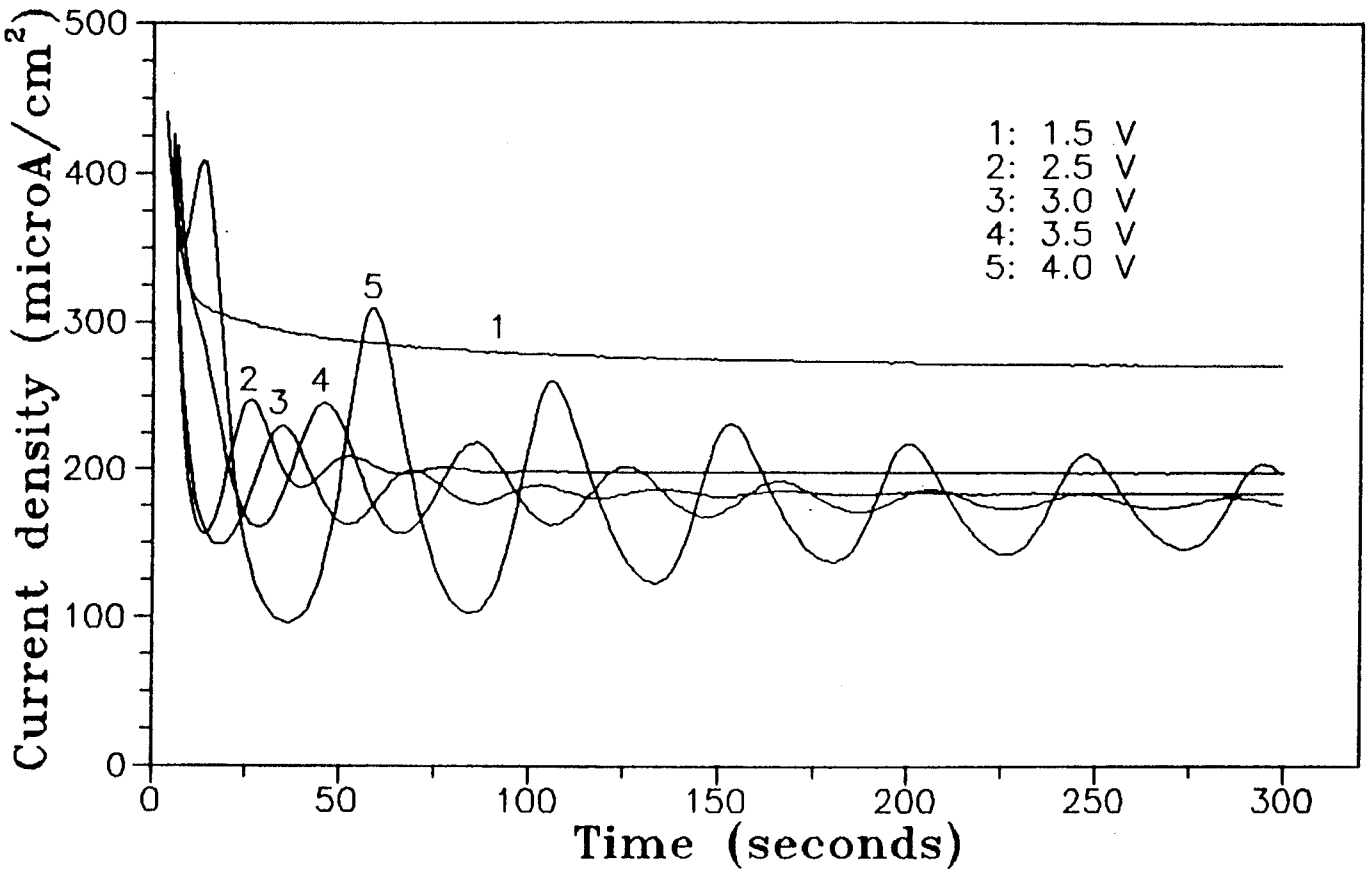
FIG. 3 depicts the oscillatory behavior of current density as a function of anodic potential for an etched silicon specimen.

FIG. 3 depicts current-time data at various anodic potentials for a silicon specimen being etched. The current density of an etched silicon specimen exhibits an oscillatory behavior that varies with the anodic potential. In consideration of the amplitude and frequency periodicity shown in FIG. 3, applicants believe that at relatively high anodic potentials (e.g., 1.5V or greater), at least another rate-determining reaction is also effective in addition to the primary diffusion-controlled dissolution reaction.

With reference to FIG. 3, at anodic potentials exceeding about 1.5V, the surface oxide film's growth rate (e.g., the rate of the electrochemical oxidation process) exceeds the relatively constant rate of the oxide film's chemical dissolution. As a result, the oxide film grows thicker, thus increasing the ohmic voltage drop lost across the oxide layer. Since this net voltage loss reduces the effective anodic potential at the specimen, the electrochemical oxidation process then begins to slow.

But eventually the rate of chemical dissolution will exceed the rate of new oxide formation, at which point the oxide film decreases, thus reducing the ohmic voltage loss. This new relationship will govern until the rate of the electrochemical oxidation process once more exceeds the rate of chemical dissolution, and so on. Applicants believe this explanation accounts for the oscillatory behavior depicted in FIG. 3.

Thus, FIG. 3 suggests that maintaining anodic potentials corresponding to the electropolishing region of the specimen, which is to say corresponding to a predominantly quadrivalent dissolution region, will promote stability of the specimen's effective dissolution valence.

Based on the data of FIG. 3 and research published during the past twenty-five years, applicants next concluded that electrolyte solutions with a relatively low fluoride content should further stabilize the effective dissolution valence. Essentially, a low fluoride electrolyte ($<1$ $mol-dm^{-3}$) should slow the dissolution rate of the surface oxide at the semiconductor-electrolyte interface relative to the electrochemical oxidation rate. This in turn would reduce the apparent sensitivity of effective dissolution valence to electrochemical profiler parameter changes and to semiconductor parameter changes.

To verify their hypothesis, applicants measured the dissolution valence of silicon using buffered NaF electrolyte solutions at various concentrations, pHs, anodic potentials and carrier concentrations, using a Semilab MCS-90 profiler.

Figure 4A:
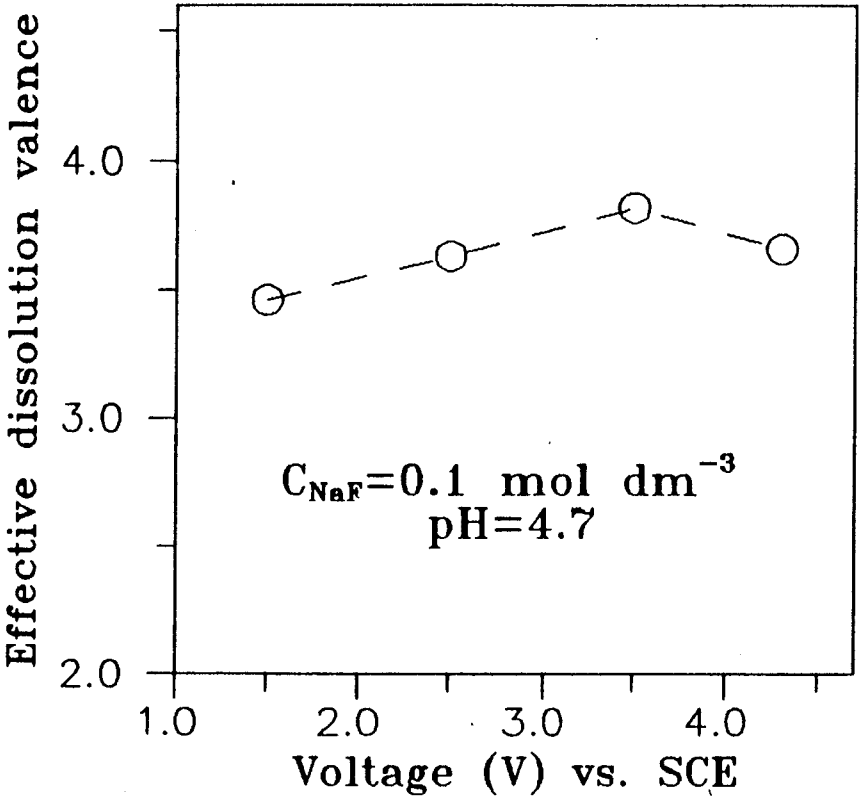
FIG. 4A depicts an increase is effective dissolution valence with increasing anodic potential.

As depicted by FIG. 4A, the effective dissolution valence of silicon increases slightly with increasing anodic potentials. As noted, data in FIG. 4A were obtained using a buffered solution of NaF with 0.1 $mol-dm^{-3}$, and a pH of 4.7.

Figure 4B:
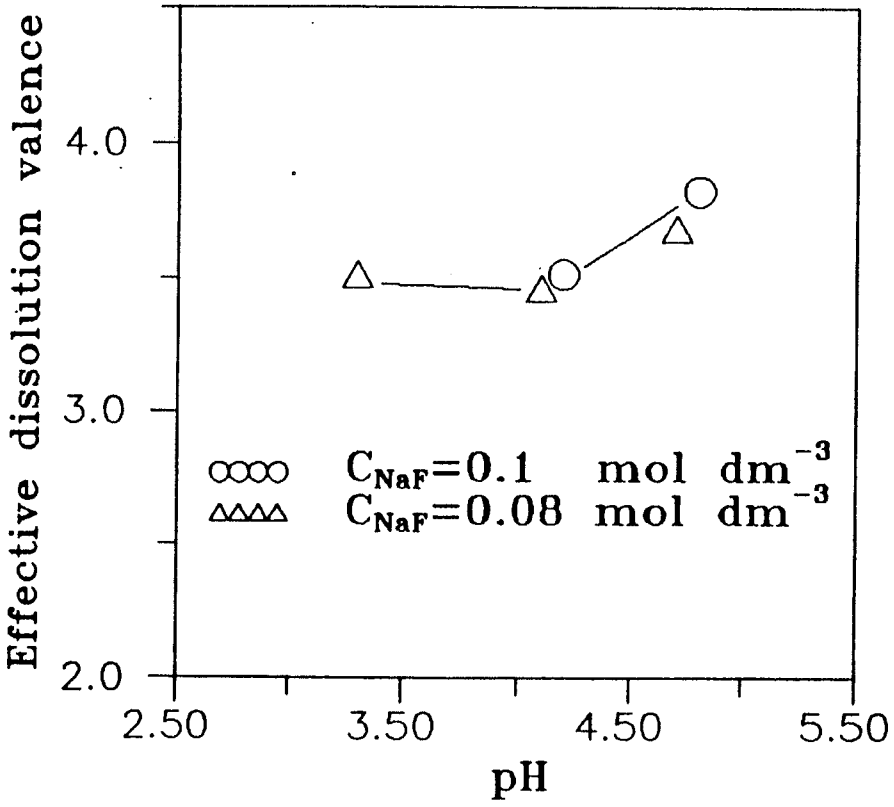
FIG. 4B depicts the variation of the effective dissolution valence with increases in electrolyte pH beyond about 4.0.

FIG. 4B reflects that the effective dissolution valence of silicon increases moderately with increasing pH. This moderate pH-anodic potential relationship is especially interesting because the dissolution current density more than doubles as pH is reduced from 4.7 to 3.3. Generally, $pH>5$ substantially reduced the rate of etching to less than about 0.3 $\mu m$ per hour, an unreasonably slow rate.

Figure 4C:
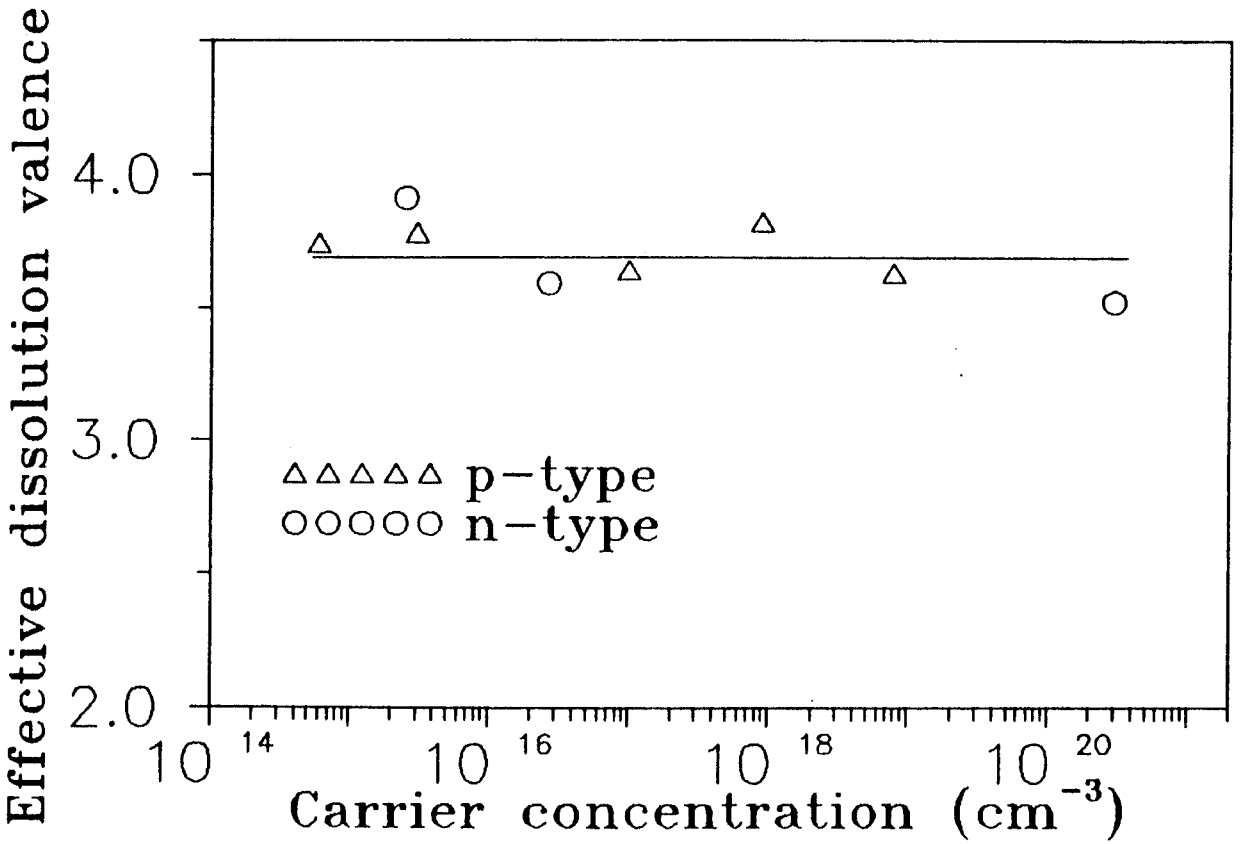
FIG. 4C depicts an essentially constant effective dissolution valence for both n-type and p-type silicon over a wide variation in semiconductor carrier concentration for specimens of <111>and <100>crystallographic orientation.

FIG. 4C demonstrates that the effective dissolution valence of n-type and p-type silicon having various crystallographic orientation (e.g., <111> and <100>) is substantially constant, despite a variation in carrier concentration of five orders of magnitude. The effective dissolution valence was measured as $3.70\pm0.12$ for either type of silicon. Data for FIG. 4C were obtained with 0.1 $mol-dm^{-3}$ $NaF+0.25$ $mol-dm^{-3}$ $Na_2WO_4$ buffered electrolyte solution having a pH of 4.7, with a 3.5V anodic potential. Earlier research by others had indicated that the effective dissolution valence of silicon was about $3.5\pm0.3$.

Figure 5A:
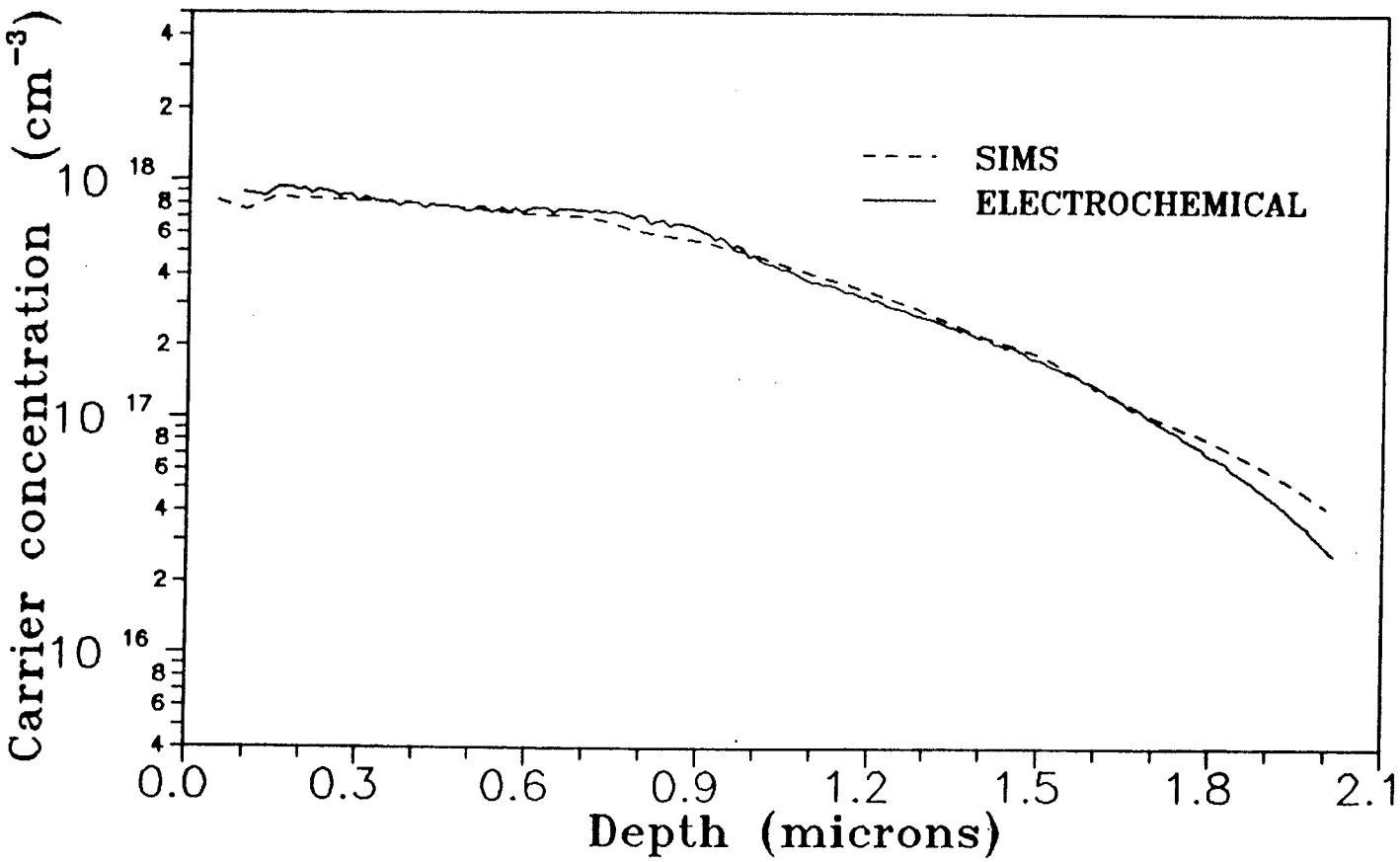
FIG. 5A depicts the carrier concentration profile for p-type silicon, as measured according to the present invention and as confirmed by secondary ion mass spectrometry ("SIMS").
Figure 5B:
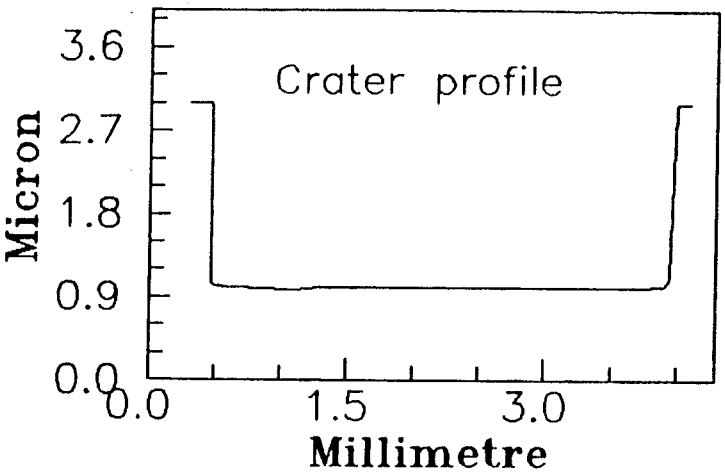
FIG. 5B depicts the resultant etch crater for the carrier concentration profile of FIG. 5A.
Figure 6A:
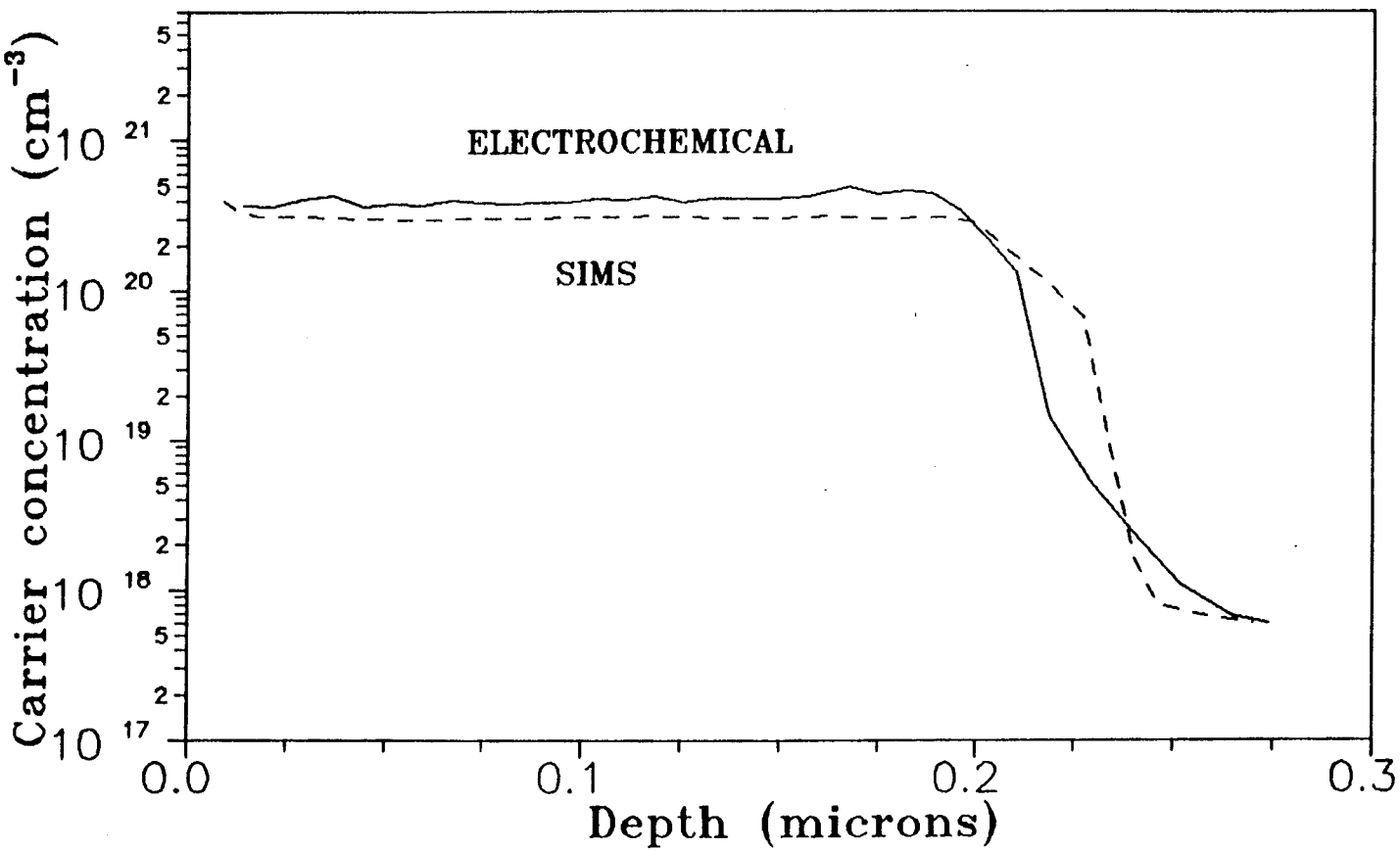
FIG. 6A depicts the carrier concentration profile for n-type silicon, as measured according to the present invention, and as confirmed by secondary ion mass spectrometry ("SIMS").
Figure 6B:
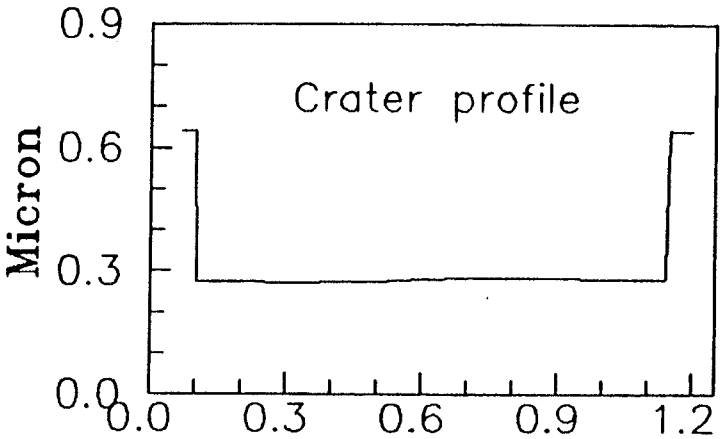
FIG. 6C depicts the resultant etch crater for the carrier concentration profile of FIG. 6A.

FIGS. 5A and 5B depict close agreement between carrier concentration profile for p-type silicon (boron-implant, 10 $mm^2$ etch area), measured according to the present invention, and by secondary ion mass spectrometry ("SIMS") measurement. The close agreement depicted in FIGS. 5A and 5B confirms that applicants' low fluoride electrolyte solution, with its associated low dissolution rate of the surface oxide (relative to the electrochemical oxidation rate), did not substantially (if at all) degrade the electrical parameters associated with the Schottky barrier formed at the silicon-electrolyte interface. The insert region of FIG. 5 demonstrates the extreme flatness and smoothness of the etch crater formed in the specimen during electrochemical profiling, according to the present invention. FIGS. 6A and 6B are a similar representation for n-type silicon (MBE grown, 0.85 $mm^2$ etch area), and demonstrates that even for very high carrier concentrations (e.g., $10^{20}/cm^3$), n-type specimens can be depth profiled. Significantly, FIGS. 6 demonstrates that even in a shallow silicon structure with a relatively small wetted area ($A=0.85$ $mm^2$), the layer thickness may be accurately determined.

To further confirm the accuracy of their data for very high concentrations in n-type semiconductor material, applicants determined the capacitance of the silicon-electrolyte interface ($C_{Si-E}$) and the metal (Au)-electrolyte double layer capacitance ($C_D$) at a measurement frequency of 6.26 kHz, in a 0.1 mol−dm$^{-3}$ NaF+0.25 mol−dm$^{-3}$ $Na_2SO_4$ electrolyte solution buffered to pH 4.7. Despite a carrier concentration of $5\times10^{20}/cm^3$, $C_D$ was measured to be at least twice as large as $C_{Si-E}$. Consequently, the depletion layer capacitance ($C_{DEP}$) was smaller than the $C_D$, e.g., $1/C_{DEP}=1/C_{Si-E}-1/C_D$, and thus the measured silicon-electrolyte interface capacitance $C_{Si-E}$ indeed related to the very thin ($<5\times10^{-3}$ μm) depletion layer, rather than the electrical double layer.

Figure 7:
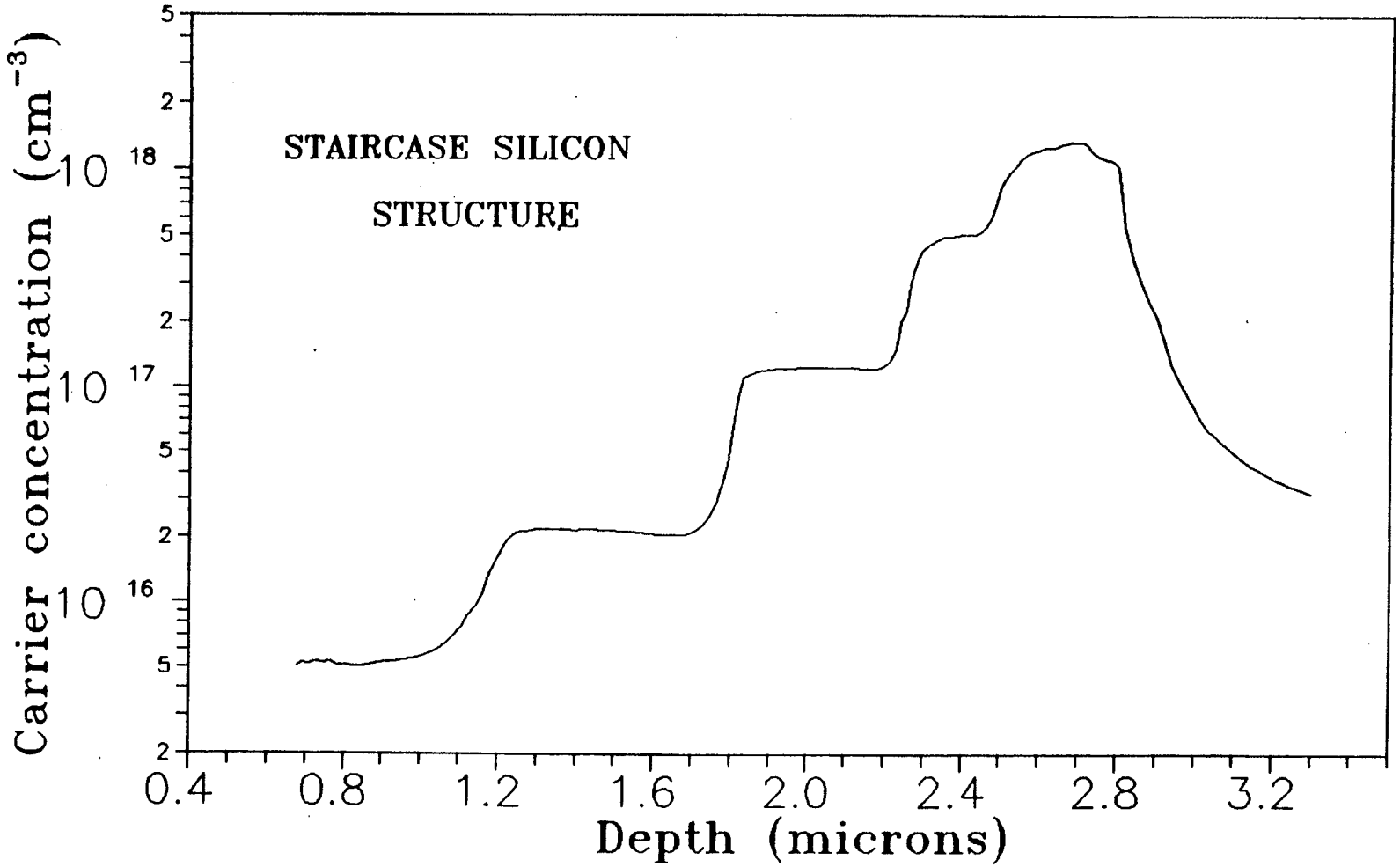
FIG. 7 depicts the measured carrier concentration profile for a complex molecular beam epitaxial grown p-type silicon structure.

FIG. 7 depicts measured data for a complex p-type, molecular beam epitaxially grown silicon structure. The stairstep graph could, for example, be used to confirm the accuracy of a molecular beam epitaxial process in a semiconductor fabrication process.

To summarize, more accurate measurements may be obtained from electrochemical depth profilers if the effective dissolution valence of the semiconductor specimen is stabilized. This valence is stabilized with the selection of an anodic potential that favors quadrivalent dissolution over divalent dissolution, e.g., that promotes electropolishing. Further, this valence is stabilized by using an electrolyte with a relatively low fluoride content, a characteristic associated with a low dissolution rate of the specimen surface oxide (contrasted to the electrochemical oxidation rate). Preferably the electrolyte is buffered and has a pH ranging from about 3 to 5.

While the present invention has been described with reference to use with a specific electrochemical profiler embodiment and relatively few semiconductor specimens, the description is illustrative of the invention and is not to be construed as limiting the invention. Various modifications may occur to those skilled in the art without departing from the true spirit and scope of the invention, as defined by the appended claims.

What is claimed is:

1. For use with electrochemical depth profiler that employs a buffered electrolyte and an anodic potential to controllably dissolve the surface of a semiconductor specimen that may be n-type or p-type to obtain data at various depths therein, a method for stabilizing the effective dissolution valence of the semiconductor specimen to enhance measurement accuracy of data dependent upon the effective dissolution valence, the method comprising the following step;

employing an anodic potential whose magnitude has at least one characteristic selected from the group consisting of (i) a magnitude associated with quadrivalent dissolution of the semiconductor specimen dominating any bivalent dissolution thereof, (ii) a magnitude associated with an electropolishing region of the semiconductor specimen, (iii) a magnitude at least exceeding a magnitude associated with a second current density peak of the semiconductor specimen, and (iv) a magnitude causing electrochemical oxidation at the semiconductor specimen surface to occur at a rate exceeding chemical dissolution.

2. The method of claim 1, wherein said anodic potential has a range of about 1V to about 5V relative to a saturated calomel reference electrode used with said profiler.

3. The method of claim 1, wherein the data dependent upon the effective dissolution valence includes carrier concentration in the semiconductor specimen.

4. The method of claim 1, wherein the buffered electrolyte is selected to promote low dissolution rate, relative to an electrochemical oxidation rate, of an oxide formed on the semiconductor specimen surface.

5. The method of claim 1, wherein the buffered electrolyte has a fluoride concentration in the range of about 0.01 mol−dm$^{-3}$ to about 1.0 mol−dm$^{-3}$.

6. The method of claim 1, wherein the buffered electrolyte comprises about 0.1 mol−dm$^{-3}$ NaF+0.25 mol−dm$^{-3}$ $Na_2SO_4$.

7. The method of claim 1, wherein the buffered electrolyte has a pH in the range of about 3 to 5.

8. The method of claim 1, wherein the semiconductor specimen is silicon and the effective dissolution valence is about 3.70.

9. The method of claim 8, wherein said effective dissolution valence is maintained constant within about ±3%.

10. The method of claim 1, wherein the effective dissolution valence is maintained substantially independent of at least one parameter selected from the group consisting of (i) semiconductor specimen carrier concentration, (ii) semiconductor specimen type, and (iii) crystallographic orientation.

11. The method of claim 1, wherein the surface of the semiconductor specimen is dissolved to produce a crater profile having a deviation from a mean profile depth of less than about ±1%.

12. The method of claim 1, including at least one further step selected from the group consisting of (i) removing gas products from the semiconductor specimen surface, (ii) agitating the buffered electrolyte at the semiconductor specimen surface to promote diffusion thereat, and (iii) providing a pump to circulate the buffered electrolyte at least adjacent the semiconductor specimen surface.

13. A method for enhancing measurement accuracy of a depth dependent characteristic in a semiconductor having an effective dissolution valence, the method comprising the following steps:

(a) causing a surface of the semiconductor to contact a buffered electrolyte associated with an electrochemical profiler and form a semiconductor working electrode, wherein said profiler includes at least a reference electrode and an auxiliary electrode, said buffered electrolyte being suitable for anodic dissilution of said semiconductor surface;

(b) anodically dissolving said semiconductor surface by applying an anodic potential between said auxiliary electrode and said semiconductor working electrode; said anodic potential, as measured between said reference electrode and said semiconductor working electrode, having a magnitude selected from the group consisting of (i) a magnitude associated with quadrivalent dissolution of the semiconductor specimen dominating any divalent dissolution thereof, (ii) a magnitude associated with an electropolishing region of the semiconductor specimen, (iii) a magnitude at least exceeding a magnitude associated with a second current density peak of the semiconductor specimen, and (iv) a magnitude causing electrochemical oxidation at the semiconductor specimen surface to occur at a rate exceeding chemical dissolution; and (c) measuring a depth dependent parameter of said semiconductor specimen;

wherein consistency of the effective dissolution valence of said semiconductor specimen is improved, and said step of measuring provides a more accurate value of said depth dependent parameter.

14. The method of claim 13, wherein said anodic potential has a range of about 1V to about 5V, relative to said reference electrode.

15. The method of claim 13, wherein said depth dependent parameter includes carrier concentration in the semiconductor specimen.

16. The method of claim 13, wherein the buffered electrolyte is selected to promote low dissolution rate relative to an electrochemical oxidation rate of an oxide formed on the semiconductor specimen surface.

17. The method of claim 13, wherein the buffered electrolyte has a fluoride concentration in the range of about 0.01 $mol-dm^{-3}$ to about 1.0 $mol-dm^{-3}$.

18. The method of claim 13, wherein the buffered electrolyte comprises about 0.1 $mol-dm^{-3}$ $NaF+0.25$ $mol-dm^{-3}$ $Na_2SO_4$.

19. The method of claim 13, wherein the buffered electrolyte has a pH in the range of about 3 to 5.

20. The method of claim 13, wherein the semiconductor specimen is silicon and the effective dissolution valence is about 3.70.

21. The method of claim 21, wherein said effective dissolution valence is maintained constant within about $+3\%$.

22. The method of claim 13, wherein the effective dissolution valence is maintained substantially independent of at least one parameter selected from the group consisting of (i) semiconductor specimen carrier concentration, (ii) semiconductor specimen type, and (iii) crystallographic orientation.

23. The method of claim 13, wherein the surface of the semiconductor specimen is dissolved to produce a crater profile having a deviation from a mean profile depth of less than about $+1\%$.

24. The method of claim 13, including at least one further step selected from the group consisting of (i) removing gas products from the semiconductor specimen surface, (ii) agitating the buffered electrolyte at the semiconductor specimen surface to promote diffusion thereat, and (iii) providing a pump to circulate the buffered electrolyte at least adjacent the semiconductor specimen surface.

* * * * *